US006892721B2

(12) United States Patent
Chen

(10) Patent No.: US 6,892,721 B2
(45) Date of Patent: May 17, 2005

(54) FOLDABLE CONDUCTION OVEN (I)

(76) Inventor: Gao-Shan Chen, No. 2, Alley 492, Hai Tian Rd. Sec. 2, Tainan City (TW)

( * ) Notice: Subject to any disclaimer, the term of this patent is extended or adjusted under 35 U.S.C. 154(b) by 50 days.

(21) Appl. No.: 10/446,846

(22) Filed: May 29, 2003

(65) Prior Publication Data

US 2004/0020373 A1 Feb. 5, 2004

(30) Foreign Application Priority Data

Aug. 1, 2002 (TW) ..... 91212088 U

(51) Int. Cl.[7] ..... F24C 1/16

(52) U.S. Cl. ..... 126/9 R; 126/9 B; 126/25 R; 126/38

(58) Field of Search ..... 126/9 R, 9 A, 126/9 B, 25 R, 38

(56) References Cited

U.S. PATENT DOCUMENTS 5,711,210 A * 1/1998 Kaufman ..... 99/340
6,439,111 B1 * 8/2002 Lu ..... 99/449
6,591,828 B1 * 7/2003 Schneider ..... 126/9 R
6,823,858 B1 * 11/2004 Chen ..... 126/9 R

* cited by examiner

*Primary Examiner*—Jiping Lu

(57) ABSTRACT

A foldable conduction oven comprises by a pedestal, a framework, an ash-collecting box, a grill and a net. The pedestal comprises by two opposite outward plates and a chassis. The framework comprises by two opposite outward cover plates, two opposite inner cover plates, two opposite inner plates and a frame. When unfold the pedestal, the four locational holes on the two long sides of the chassis of the pedestal are against the four round prominent pellets on the four side edges of the two outward plates; then the two outward plates are able to be folded on the chassis. When unfold the framework, the four round prominent pellets on the two outward cover plates, the four round prominent pellets on the two inner cover plates and four prominent pellets on the two inner plates are connected with the twelve locational holes on the frame, then the two outward cover plates, the two inner cover plates and the two inner plates are able to be folded on the frame. The foldable conduction oven provides convenience and practicability, because the invention is able to be folded or unfolded without any tools and easy to be carried or picked up.

3 Claims, 16 Drawing Sheets

FOLDABLE CONDUCTION OVEN (I)

BACKGROUND OF THE INVENTION

The present invention relates to a conduction oven, and more particularly to a foldable conduction oven which is folded or unfolded quickly without any tools and easy to be carried or picked up.

A conventional conduction oven isn't foldable without tools and the space is always wasted because of the large volume of a conventional conduction oven.

SUMMARY OF THE INVENTION

A foldable conduction oven comprises by a pedestal, a framework, an ash-collecting box, a grill and a net.

The pedestal comprises by two opposite outward plates and a chassis. The framework comprises by two opposite outward cover plates, two opposite inner cover plates, two opposite inner plates and a frame.

When unfold the pedestal, the four locational holes on the two long sides of the chassis of the pedestal are against the four round prominent pellets on the four side edges of the two outward plates; then the two outward plates are able to be folded on the chassis. When unfold the framework, the four round prominent pellets on the two outward cover plates, the four round prominent pellets on the two inner cover plates and four prominent pellets on the two inner plates are connected with the twelve locational holes on the frame, then the two outward cover plates, the two inner cover plates and the two inner plates are able to be folded on the frame. The foldable conduction oven provides convenience and practicability, because the invention is able to be folded or unfolded without any tools and easy to be carried or picked up.

DETAILED DESCRIPTION OF THE INVENTION

Figure 1:
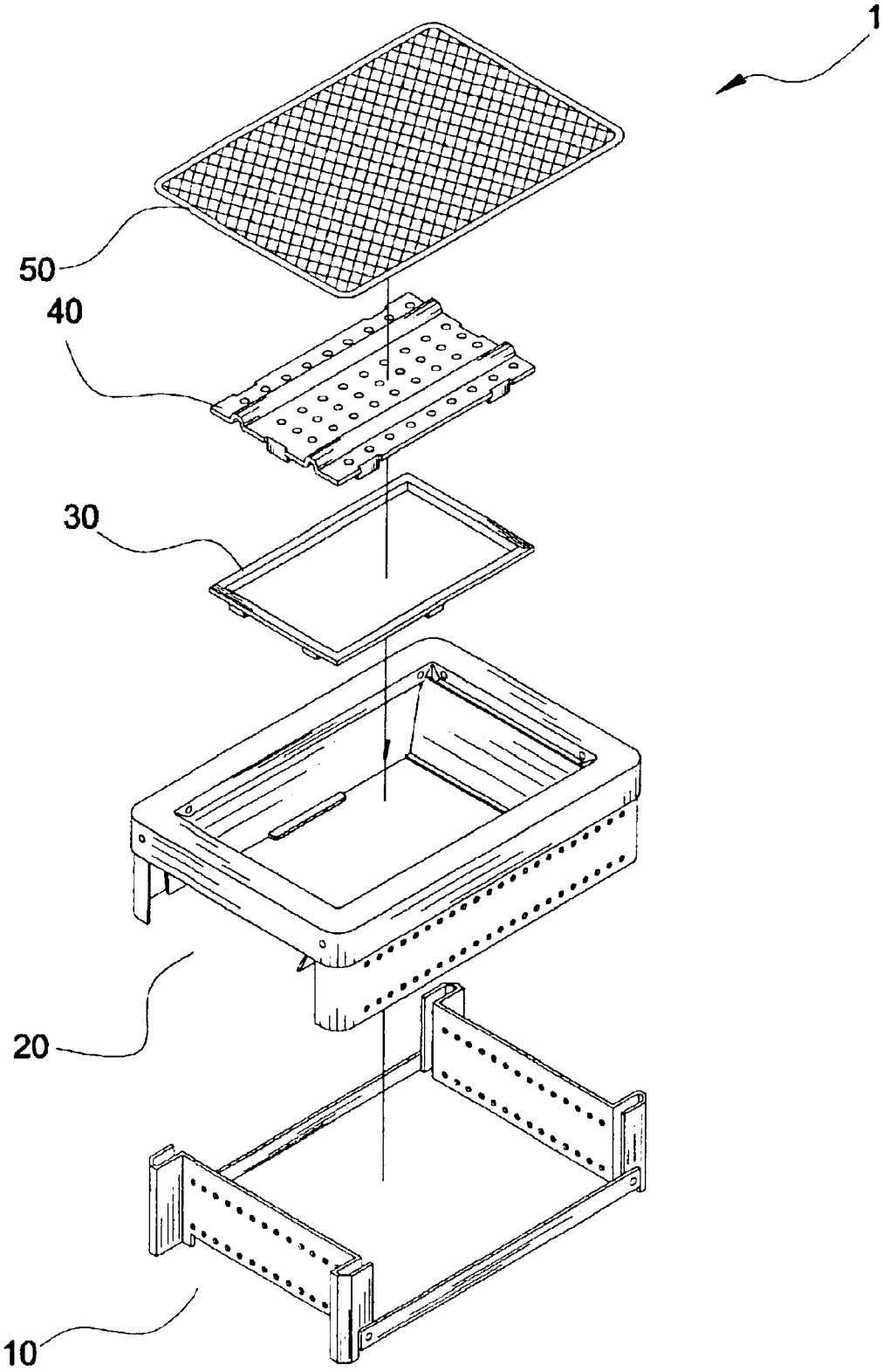
FIG. 1 is a perspective exploded view of a foldable conduction oven in accordance with this invention.

Referring to FIG. 1, the foldable conduction oven 1 comprises by a pedestal 10, a framework 20, an ash-collecting box 30, a grill 40 and a net 50.

Figure 2:
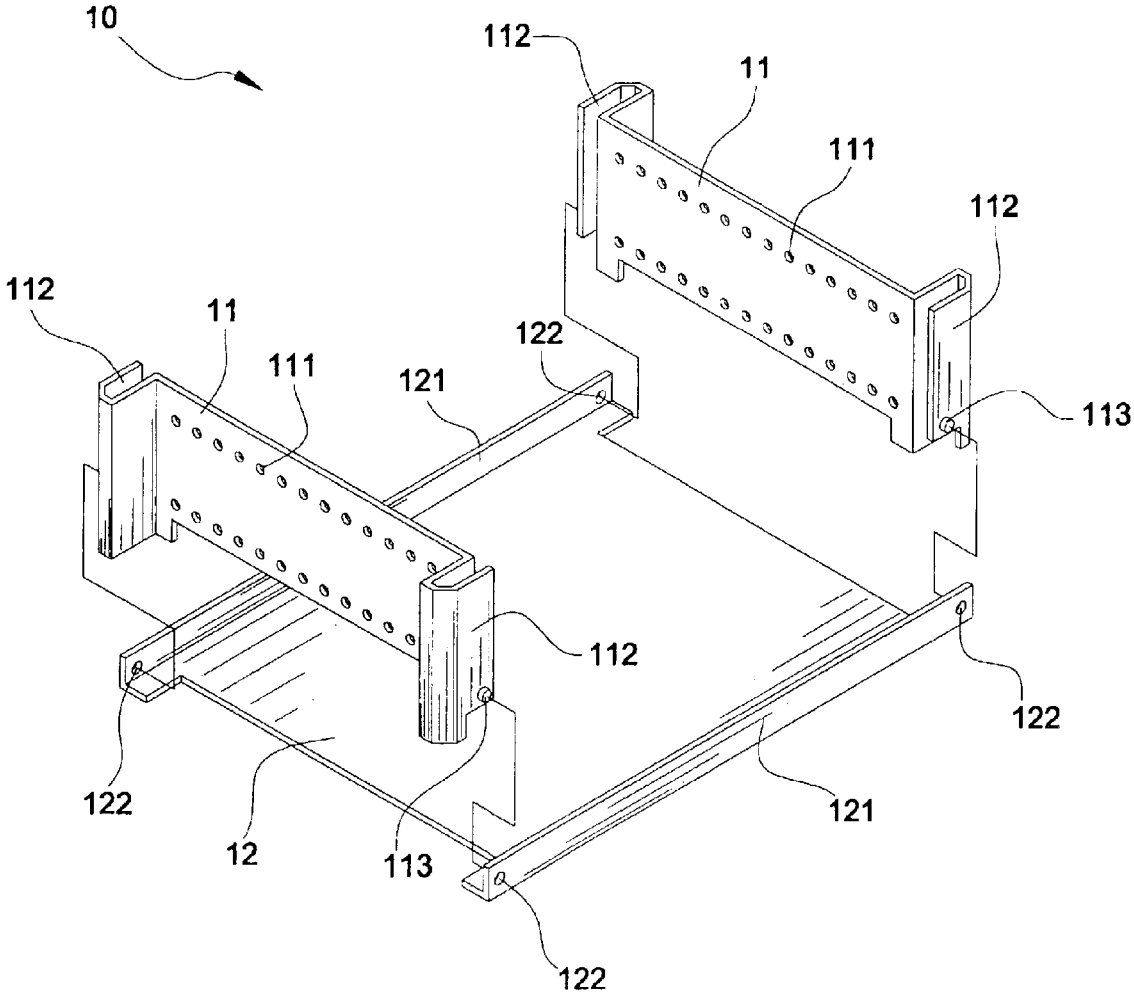
FIG. 2 is a perspective exploded view of a pedestal of a foldable conduction oven in accordance with this invention.

Referring to FIG. 2, the pedestal 10 comprises by two opposite outward plates 11 and a chassis 12.

The each outward plate 11 has many holes 111 on the outside and two opposite side edges 112 on two ends, one round prominent pellet 113 on the one side edge 112.

The chassis 12 has two opposite long sides 121. The each long side 121 has two locational holes 122 on two sides. The four locational holes 122 on the two long sides 121 of the chassis 12 correspond to the four round prominent pellets 113 on the four side edges 112 of the two outward plates 11. The four locational holes 122 are able to be wedged into the four round prominent pellets 113 on the two outward plates 11. Then the two outward plates 11 are able to be folded on the chassis 12.

Figure 3:
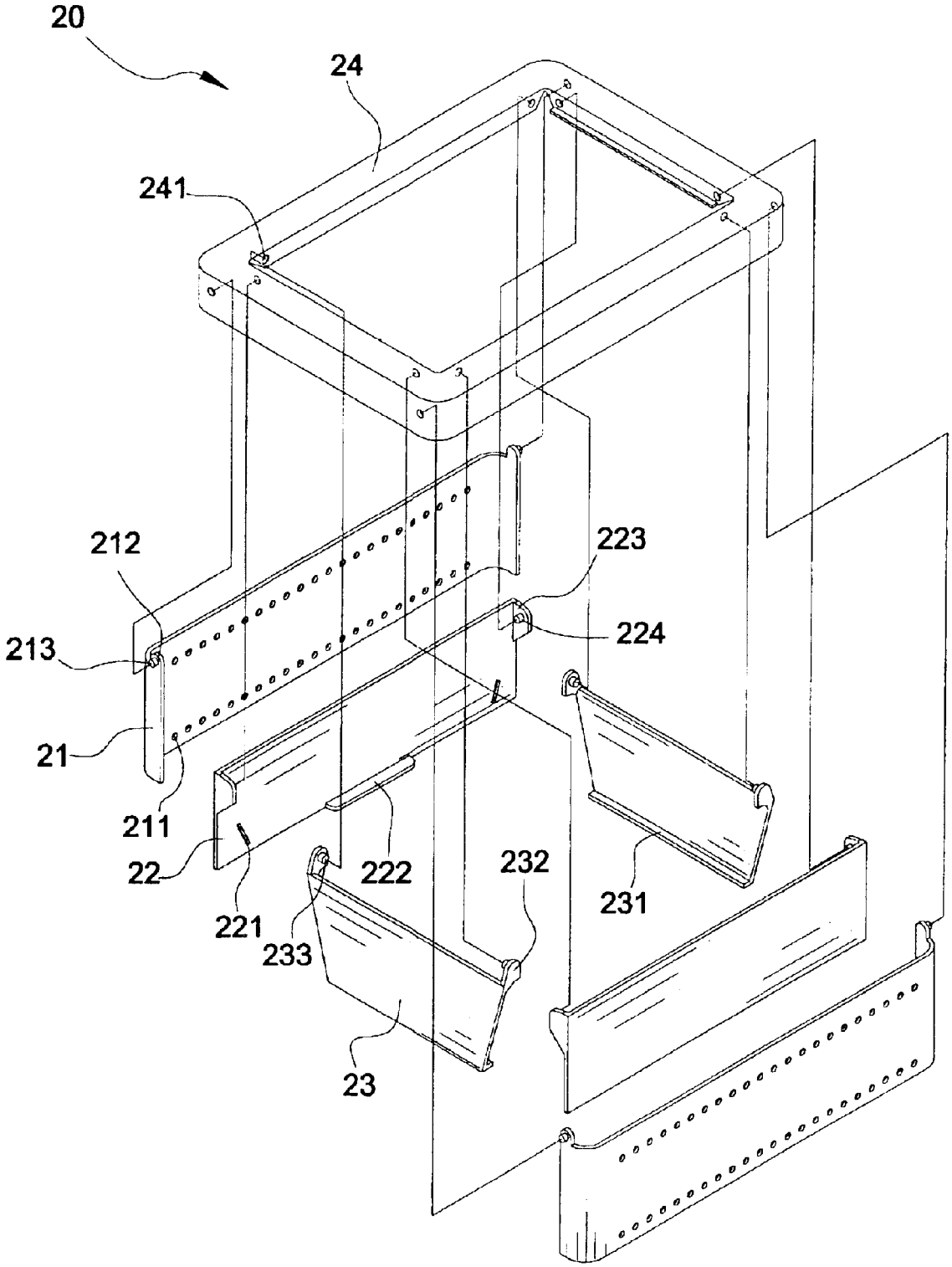
FIG. 3 is a perspective exploded view of a framework of a foldable conduction oven in accordance with this invention.

Referring to FIG. 3, the framework 20 comprises by two opposite outward cover plates 21, two opposite inner cover plates 22, two opposite inner plates 23 and a frame 24.

The each outward cover plate 21 has many holes 211 and two opposite lugs 212 on two ends, one round prominent pellet 213 on the one lug 212.

The each inner cover plate 22 has two blockers 221 and a prominent piece 222 on the inner surface and two opposite lugs 223 on two ends, one round prominent pellet 224 on the one lug 223.

The each inner plate 23 has a prominent piece 231 and two opposite lugs 232 on two ends, one round prominent pellet 233 on the one lug 232.

The frame 24 has twelve locational holes 241 to correspond the four round prominent pellets 213, which are on the four lugs 212 of the two outward cover plates 21, the four round prominent pellets 224, which are on the four lugs 223 of the two inner cover plates 22 and the four round prominent pellets 233, which are on the four lugs 232 of the two inner plates 23. The twelve locational holes are able to be wedged into the four round prominent pellets 213, which are on the two outward cover plates 21, the four round prominent pellets 224, which are on the two inner cover plates 22 and the four round prominent pellets 233, which are on the two inner plates 23. Then the two outward cover plates 21, the two inner cover plates 22 and the two inner plates 23 are able to be folded on the frame 24.

Figure 4:
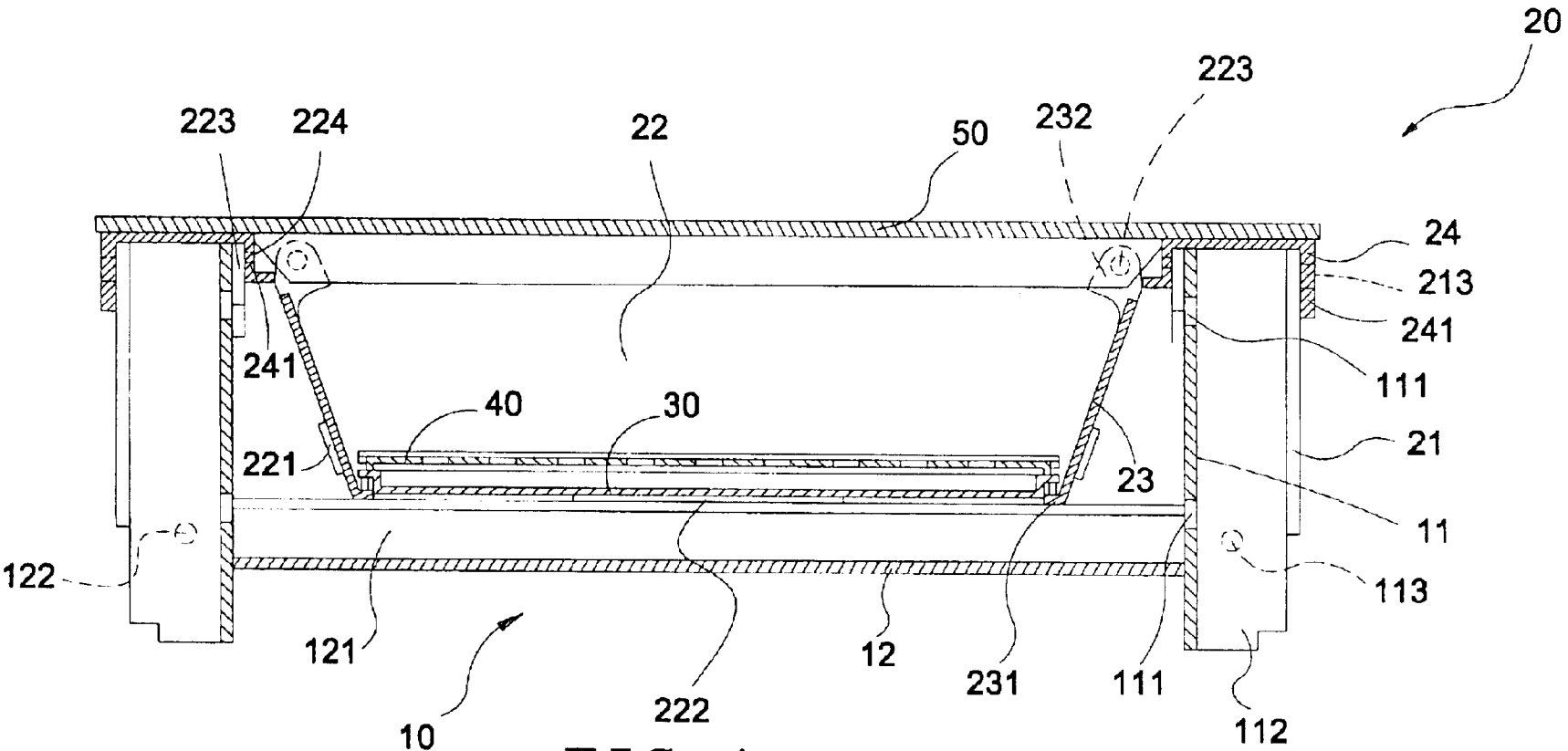
FIG. 4 is a cutaway assembly view of a foldable conduction oven in accordance with this invention.
Figure 5:
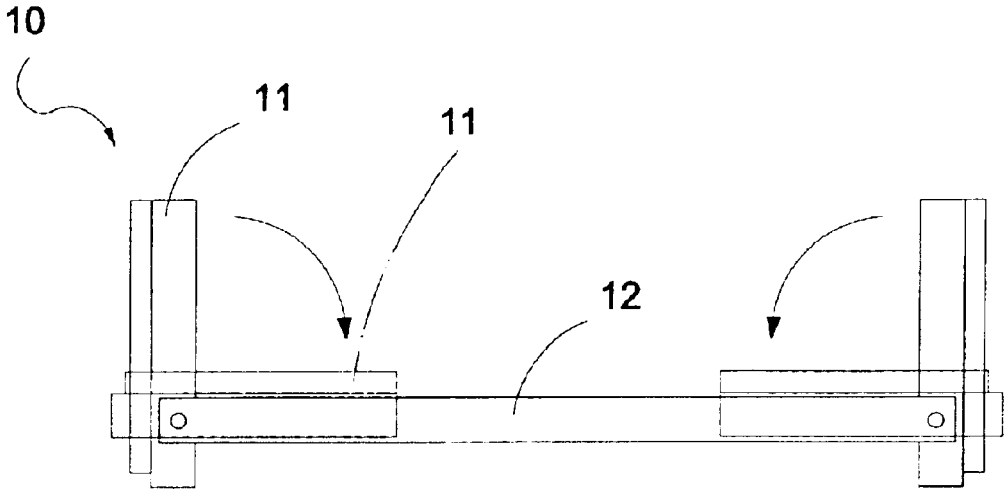
FIG. 5 is an operate diagram of a folded pedestal of a foldable conduction oven in accordance with this invention.
Figure 6:
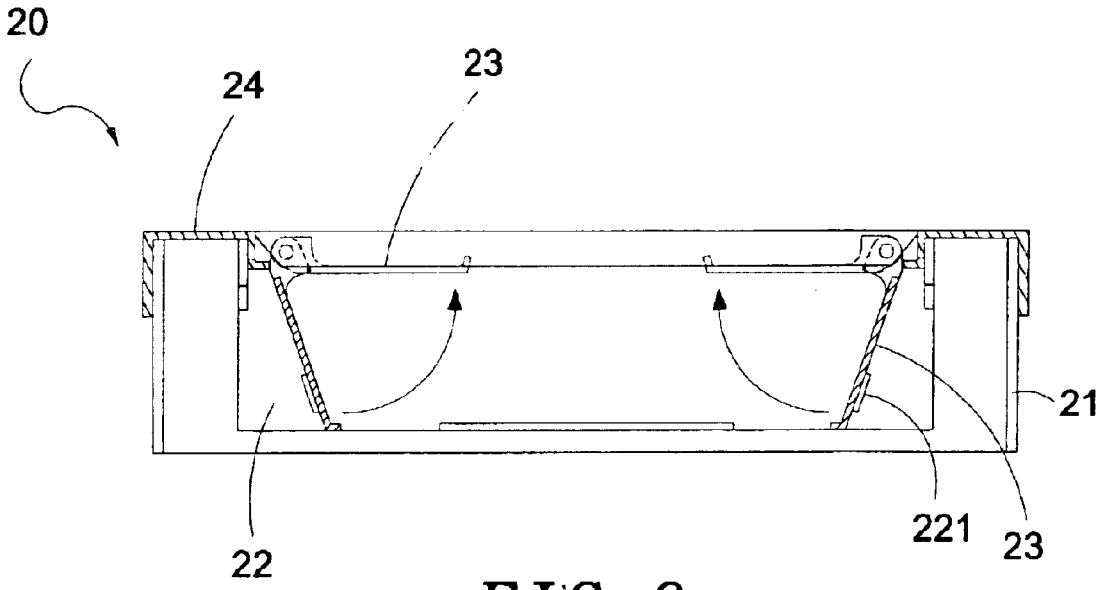
FIG. 6 is an operate diagram of a folded framework of a foldable conduction oven in accordance with this invention.
Figure 7:
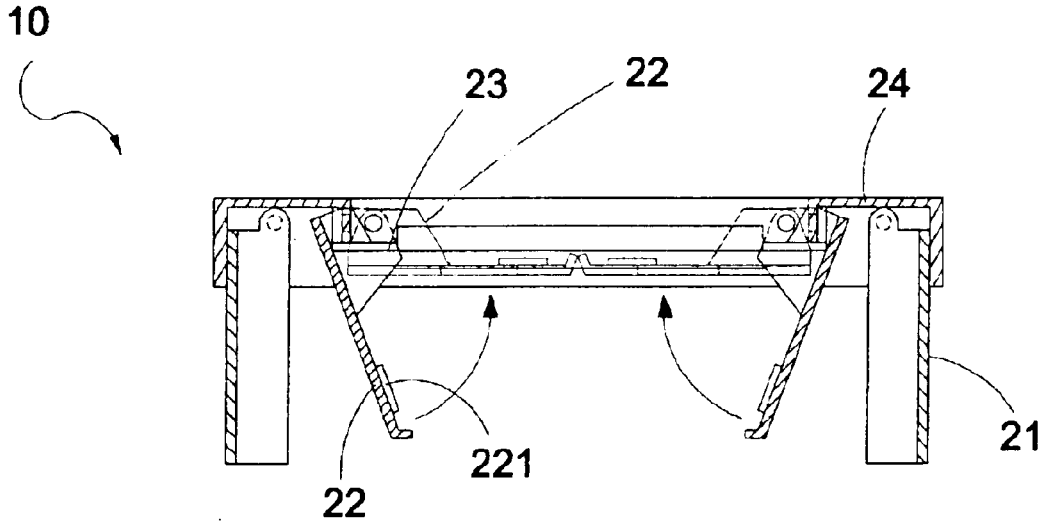
FIG. 7 is a second operate diagram of a folded framework of a foldable conduction oven in accordance with this invention.
Figure 8:
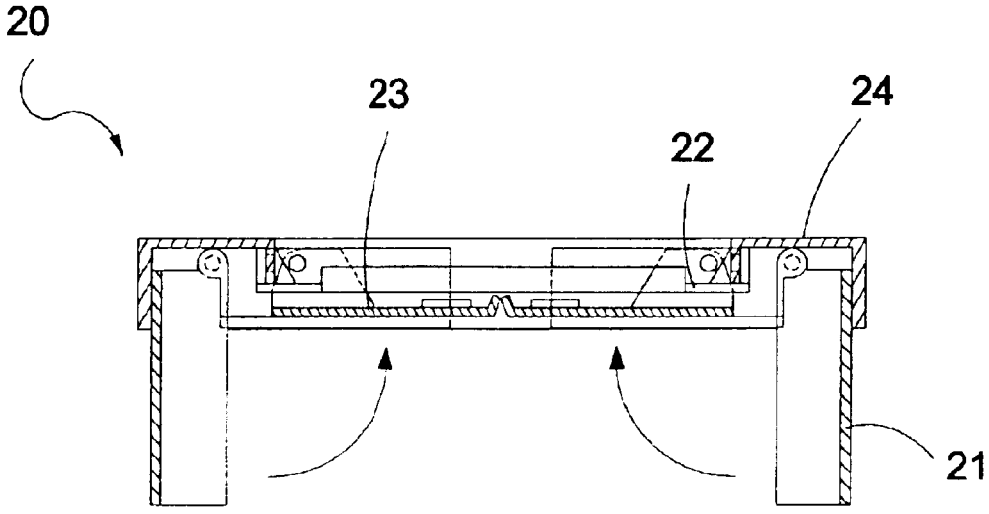
FIG. 8 is a third operate diagram of a folded framework of a foldable conduction oven in accordance with this invention.

Referring to FIG. 4, in assembly, the pedestal 10 is connected with the framework 20 by the structures of the two outward plates 11 and the two outward cover plates 12.

The ash-collecting box 30 is put on the two prominent pieces 222 of the two inner cover plates 22 and the two prominent pieces 231 of the two inner plates 23.

The grill 40 is put on the ash-collecting box 30.

The net 50 is put on the surface of the framework 20.

Referring to FIGS. 5 to 8, the two outward plates 11 are folded on the chassis 12; then the two inner plates 23 are first folded, the two inner cover plates 22 are folded next, and the two outward cover plates 21 are folded final on the frame 24 to completely fold the framework 20.

Figure 9:
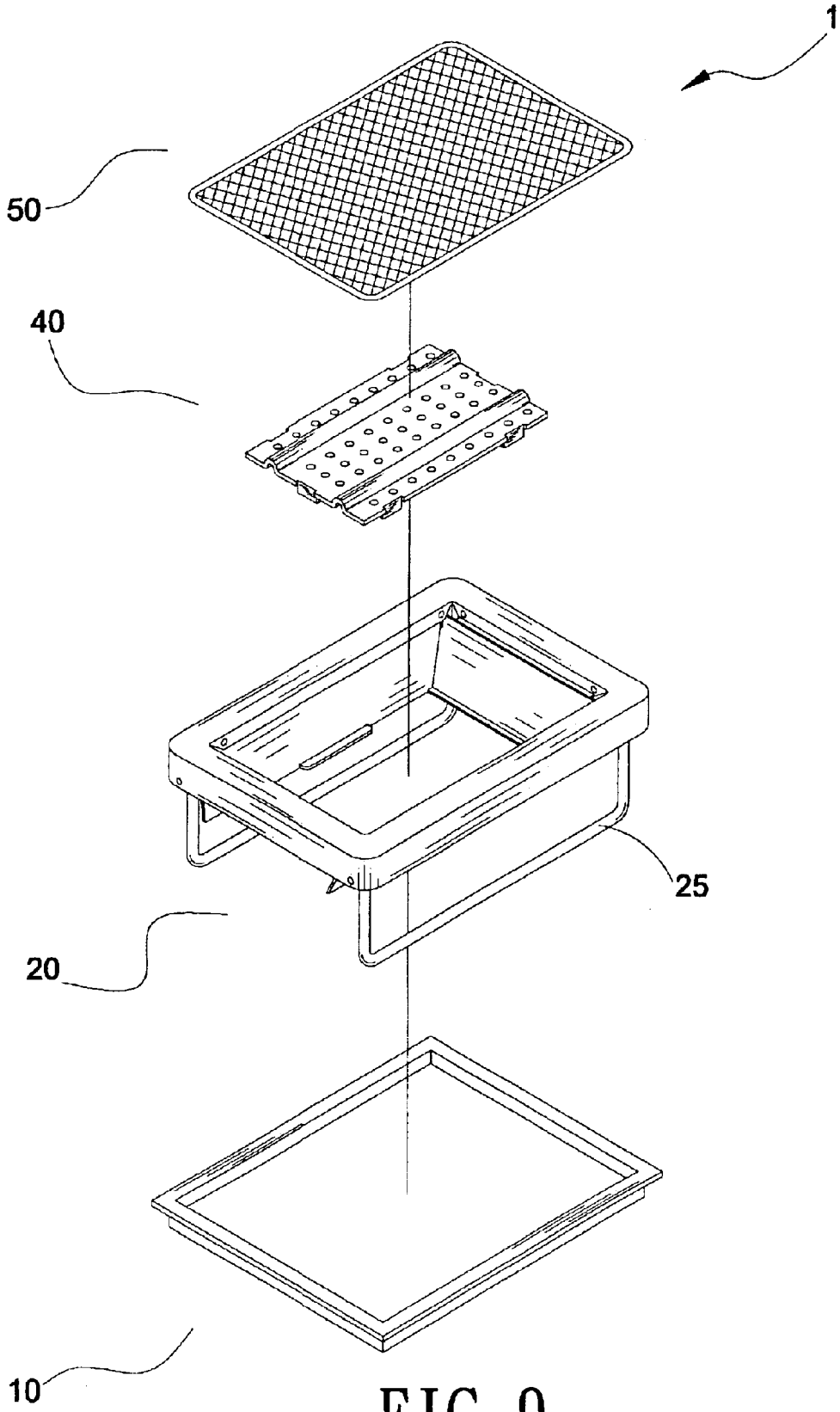
FIG. 9 is a second operate perspective exploded view of a foldable conduction oven.
Figure 10:
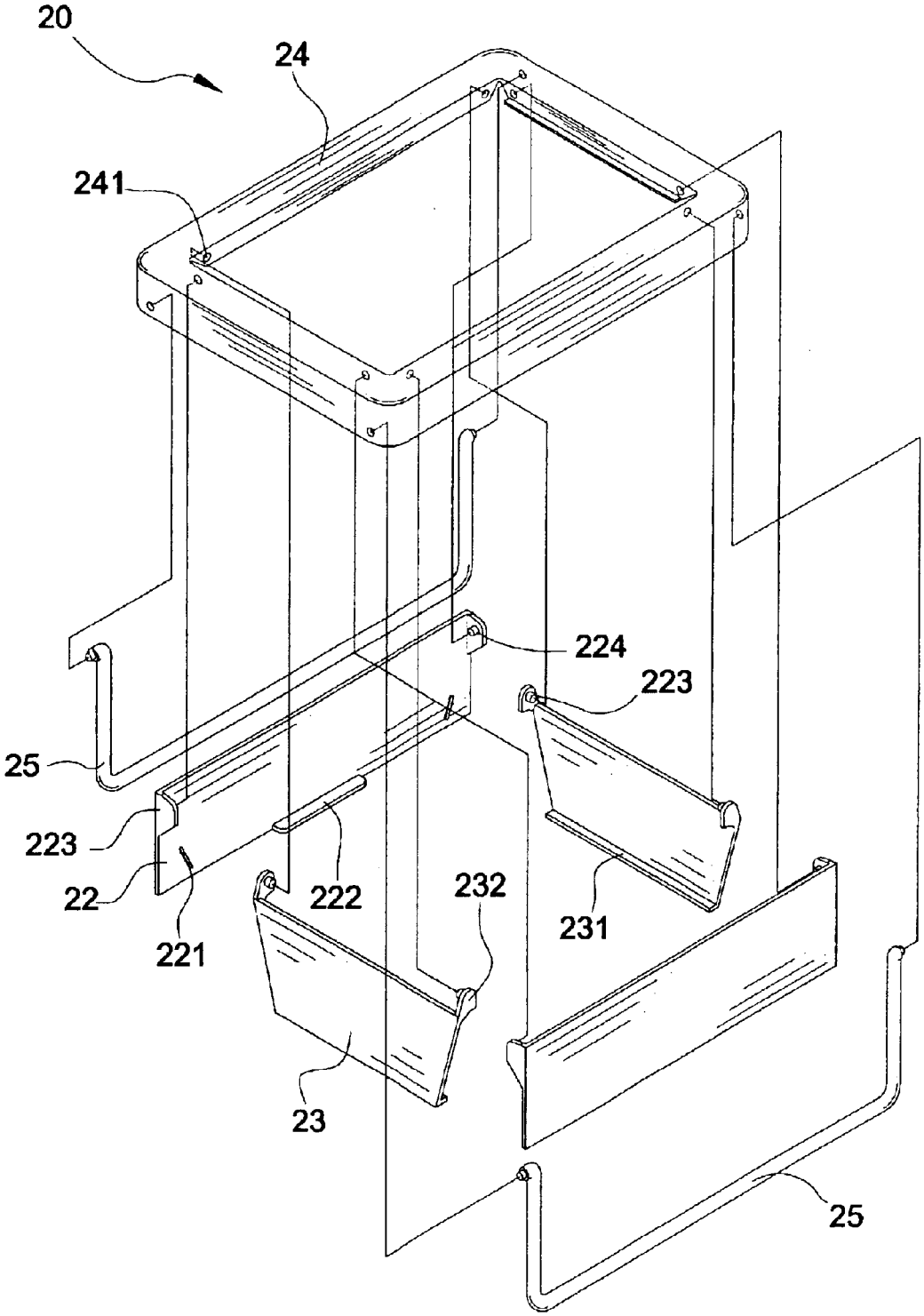
FIG. 10 is a second operate perspective exploded view of a framework on a foldable conduction oven.
Figure 11:
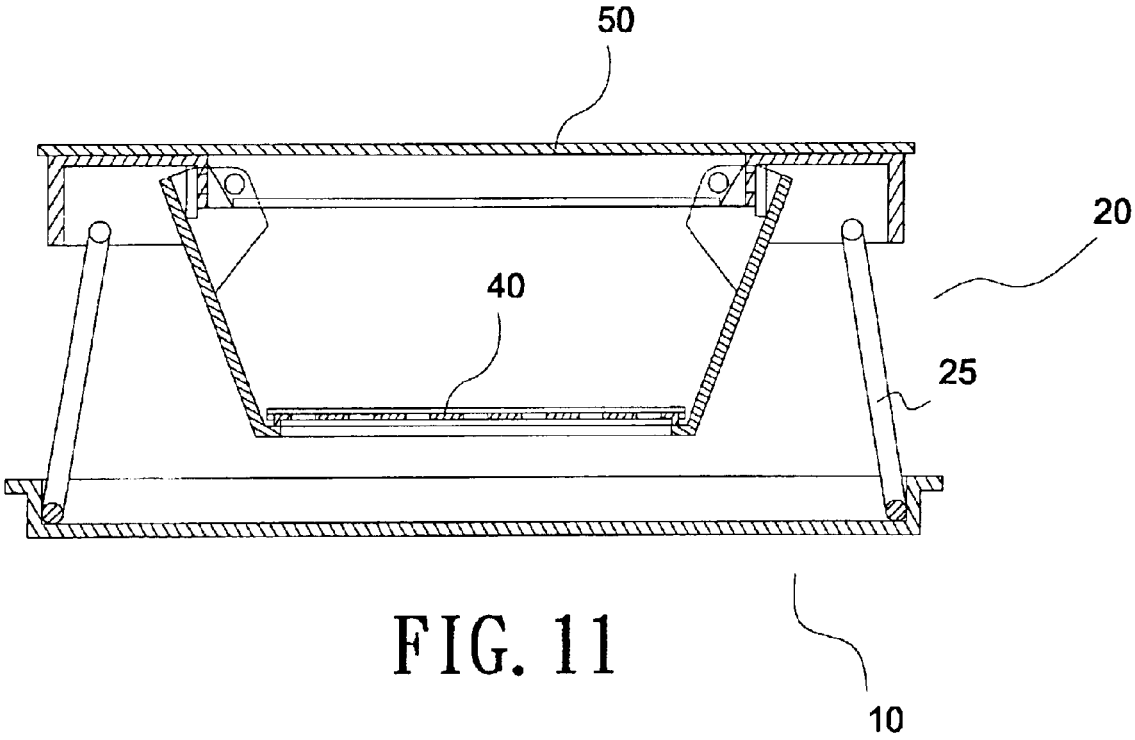
FIG. 11 is a second cutaway assembly view of a foldable conduction oven.

Referring to FIGS. 9 to 11, the second operate exemplary embodiment of the foldable conduction oven. The foldable conduction oven comprises 1 by a pedestal 10, a framework 20, a grill 40 and a net 50.

The pedestal 10 is a square box.

The framework 20 comprises by two opposite ⊔-shaped legs 25, two opposite inner cover plates 22, two opposite inner plates 23 and a frame 24.

The each ⊔-shaped leg 25 has two round prominent pellets on two sides.

The each inner cover plate 22 has two blockers 221 and a prominent piece 222 on the inner surface and two opposite lugs 223 on two ends, one round prominent pellet 224 on the one lug 223.

The each inner plate 23 has a prominent piece 231 and two opposite lugs 232 on two ends, one round prominent pellet 233 on the one lug 232.

The frame 24 has twelve locational holes 241 to correspond the four round prominent pellets, which are on the ⊔-shaped legs 25, the four round prominent pellets 224, which are on the four lugs 223 of the two inner cover plates 22 and the four round prominent pellets 233, which are on the four lugs 232 of the two inner plates 23. The twelve locational holes 241 are able to be wedged into the four round prominent pellets, which are on the ⊔-shaped legs 25, the four round prominent pellets 224, which are on the two inner cover plates 22 and the four round prominent pellets 233, which are on the two inner plates 23. Then the ⊔-shaped legs 25, the two inner cover plates 22 and the two inner plates 23 are able to be folded on the frame 24.

In assembly, the framework 20 is put on the pedestal 10.

The grill 40 is put on the two prominent pieces 222 of the two inner cover plates 22 and the two prominent pieces 231 of the two inner plates 23.

The net 50 is put on the surface of the framework 20.

Figure 12:
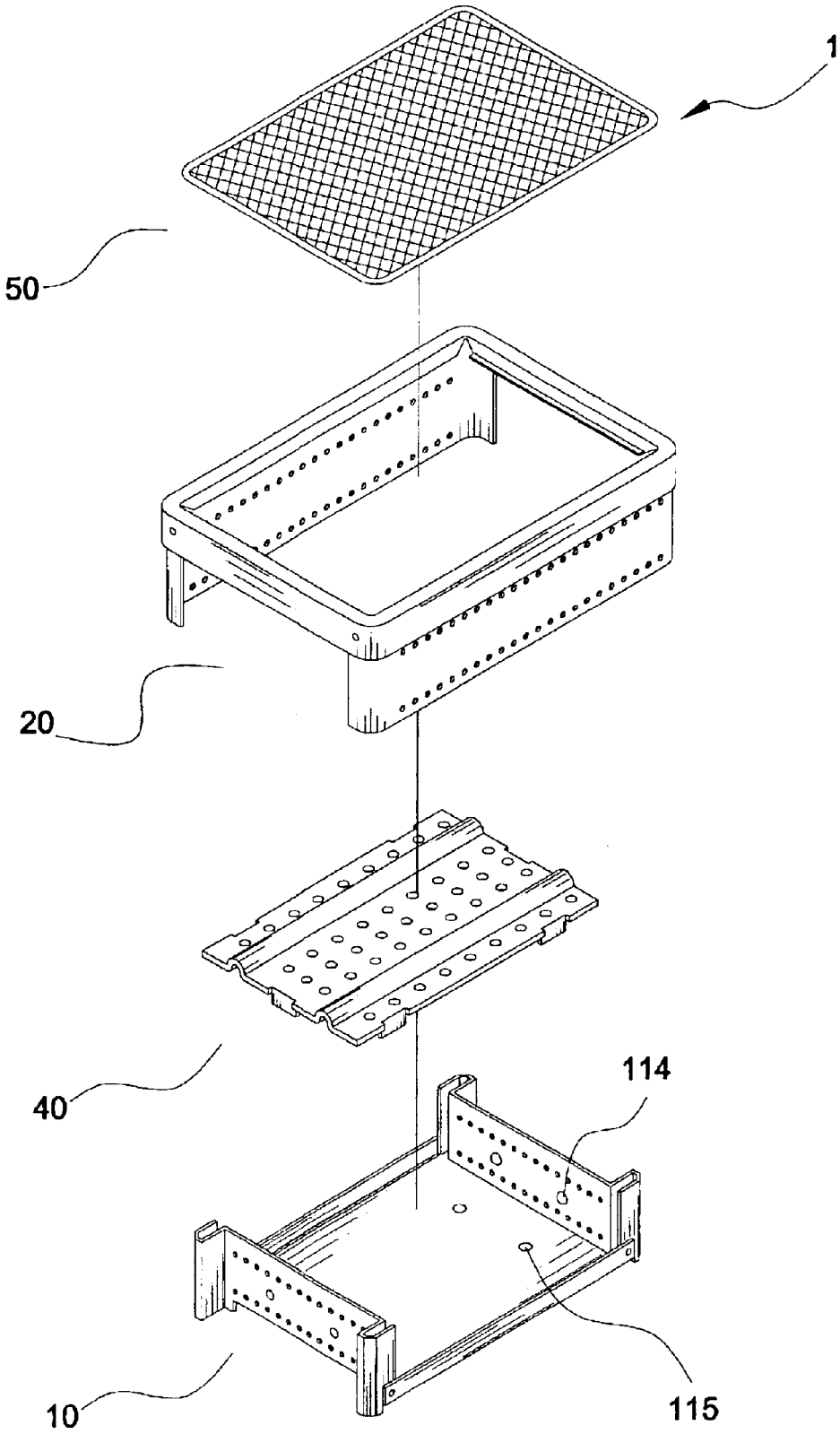
FIG. 12 is a third operate perspective exploded view of a foldable conduction oven.
Figure 13:
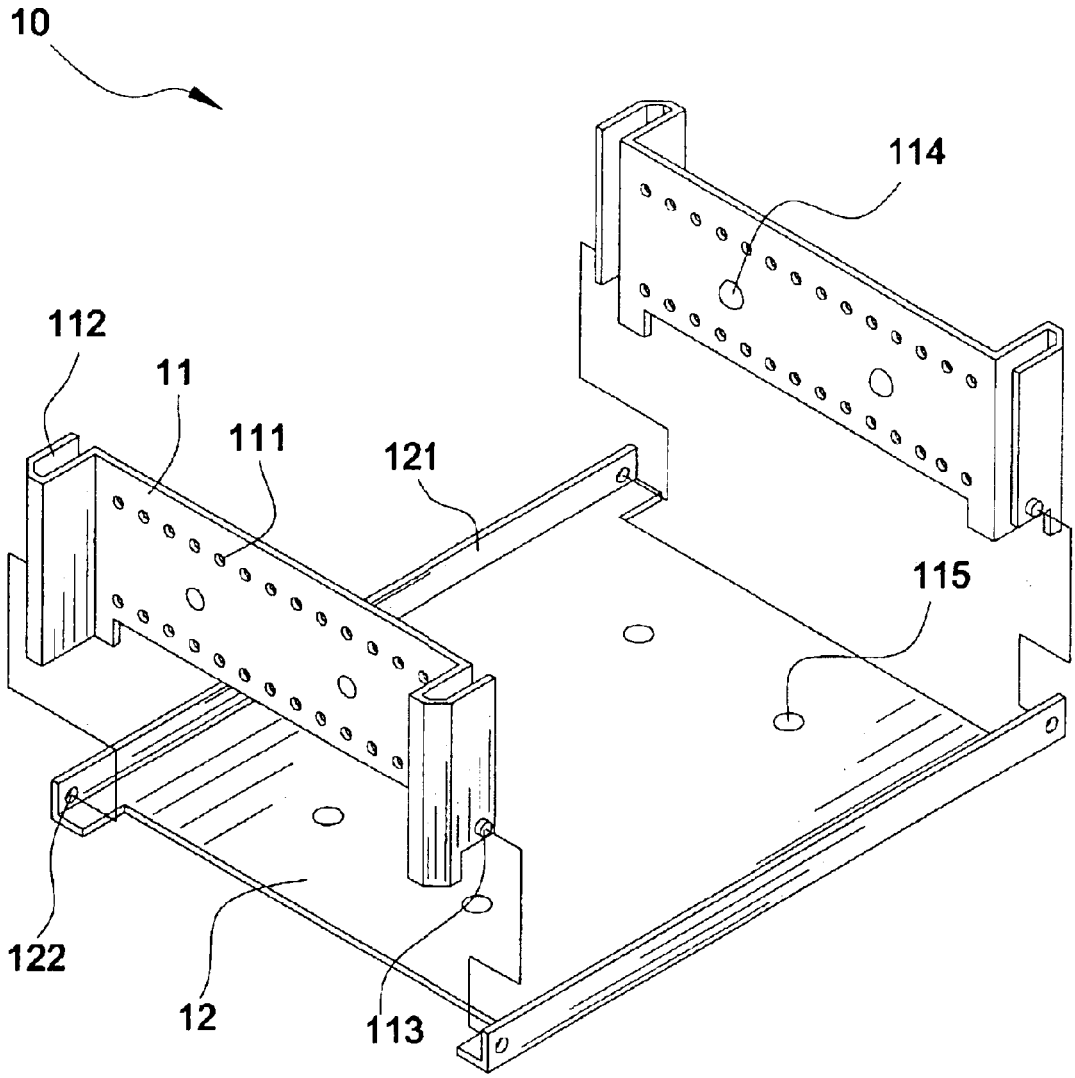
FIG. 13 is a third operate perspective exploded view of a pedestal on a foldable conduction oven.
Figure 14:
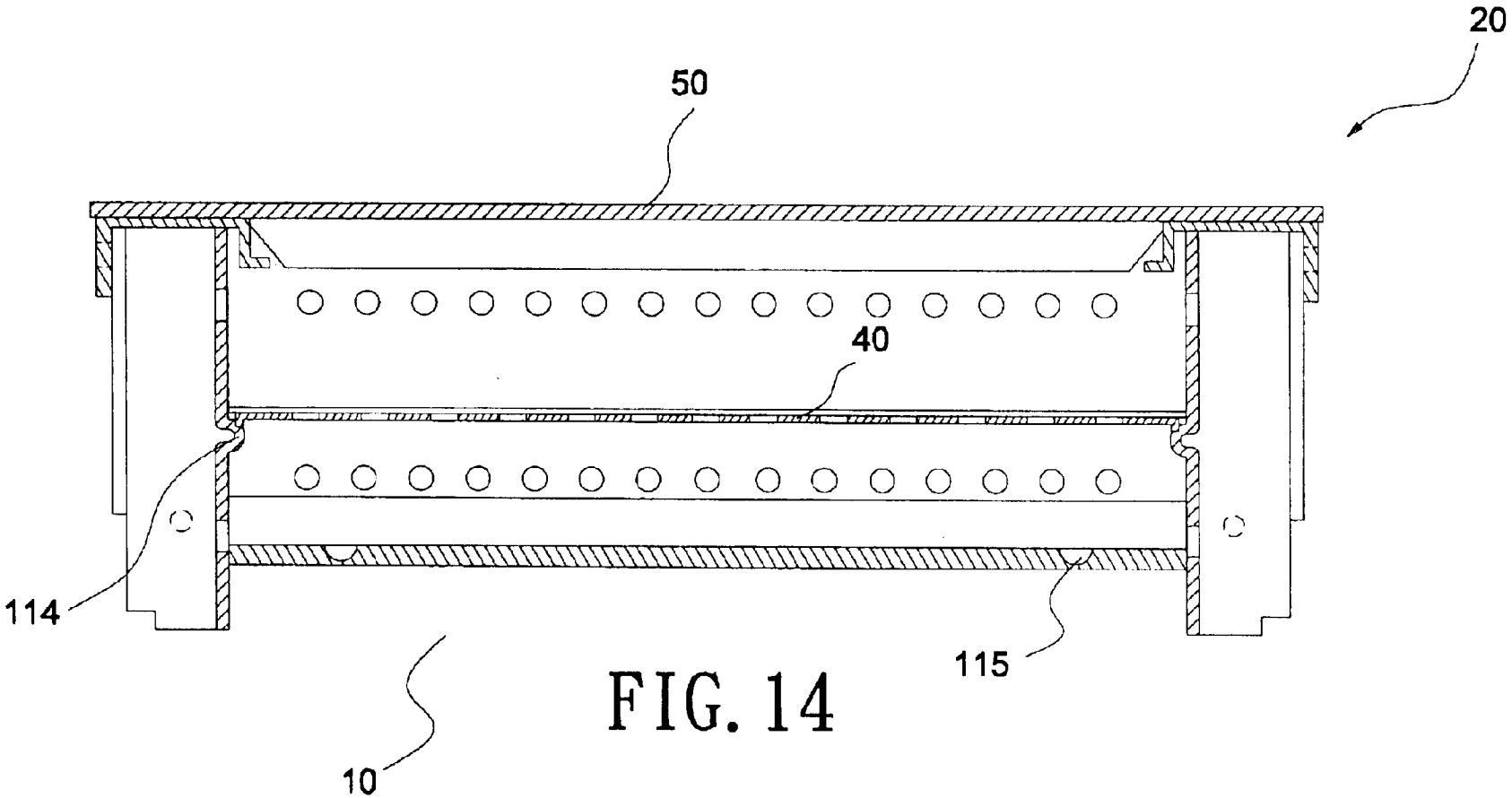
FIG. 14 is a third cutaway assembly view of a foldable conduction oven.

Referring to FIGS. 12 to 14, the third operate exemplary embodiment of the foldable conduction oven. The foldable conduction oven comprises 1 by a pedestal 10, a framework 20, a grill 40 and a net 50.

The pedestal 10 comprises by two opposite outward plates 11 and a chassis 12.

The each outward plate 11 has many holes 111, two block prominent pellets 114 on the central and two opposite side edges 112 on the two ends, one round prominent pellet 113 on lower end of the one side edge 112.

The chassis 12 has four holes 115 in the central surface to correspond the four block prominent pellets 114 on the two outward plates 11. The chassis 12 has two long sides 121. The each long side 121 of the chassis 12 has two locational holes 122 on two sides. The four round holes 115 are able to be wedged into the four round prominent pellets 114 on the two outward plates 11. Then the two outward plates 11 are able to be folded on the chassis 12.

The framework 20 comprises by two opposite outward cover plates 21 and a frame 24.

In assembly, the grill 40 is put on the two block prominent pellets 114 of the two outward cover plates 11.

The framework 20 is put on the pedestal 10.

The net 50 is put on the surface of the framework 20.

Figure 15:
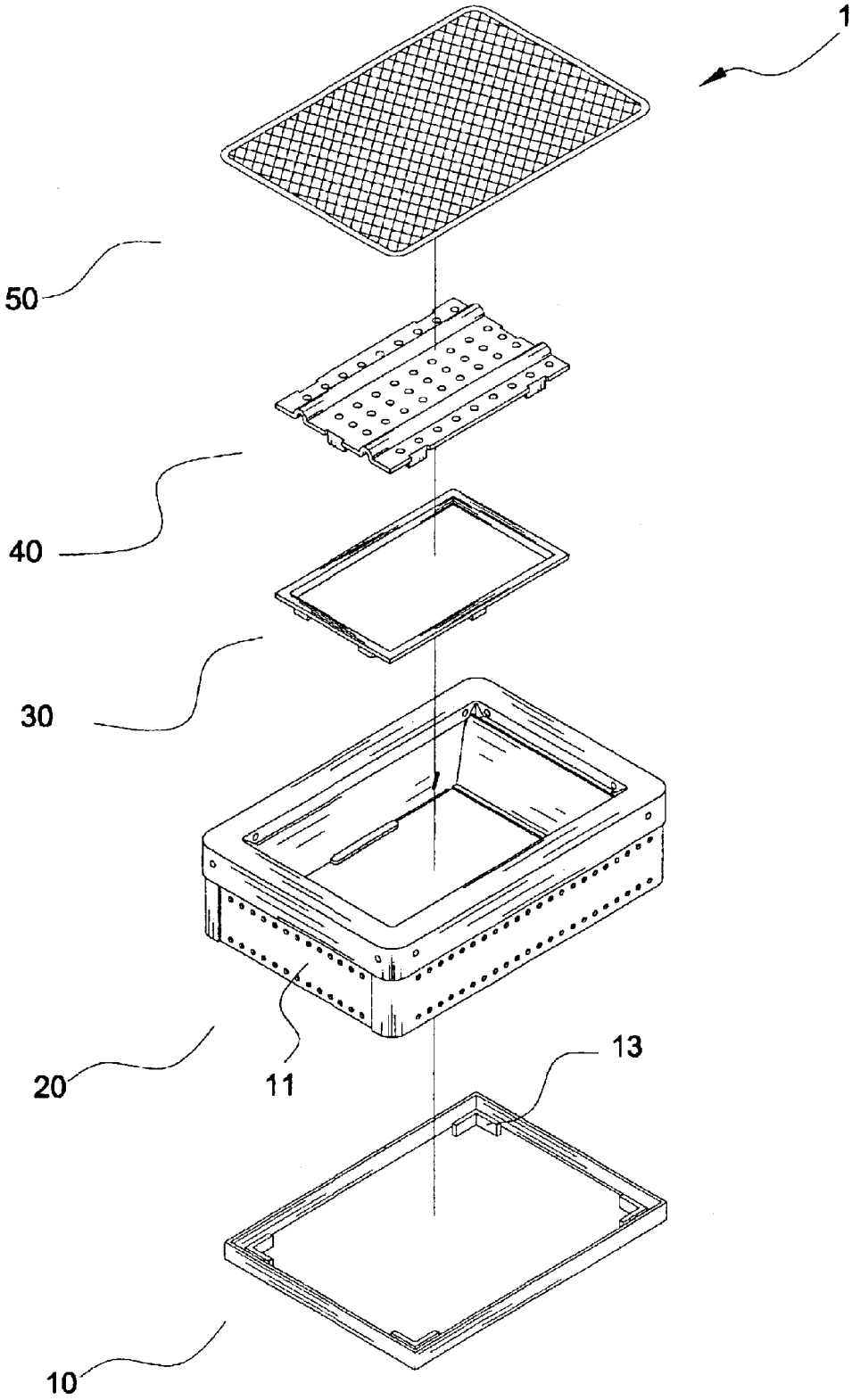
FIG. 15 is a fourth operate perspective exploded view of a foldable conduction oven.
Figure 16:
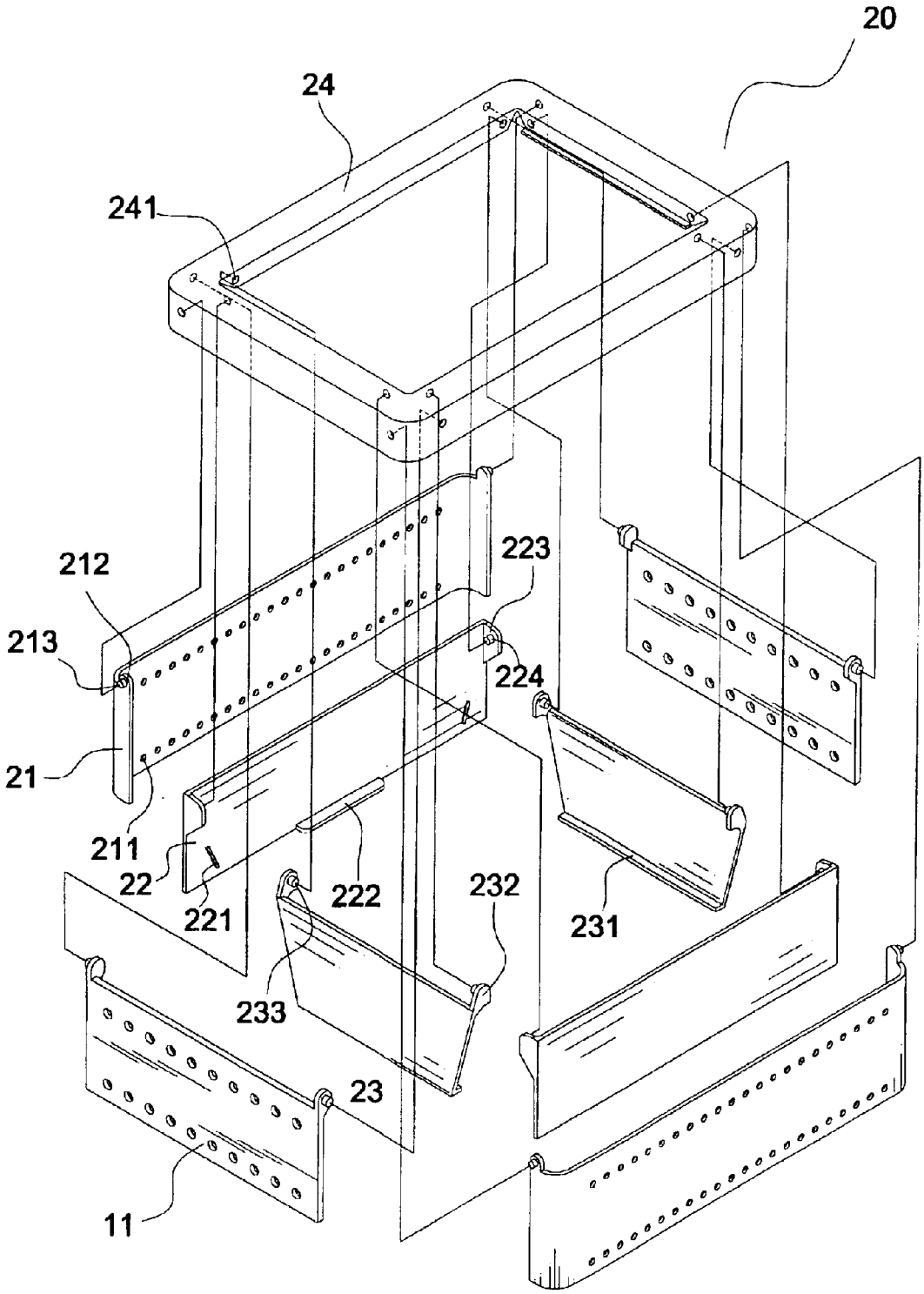
FIG. 16 is a fourth operate perspective exploded view of a framework on a foldable conduction oven.
Figure 17:
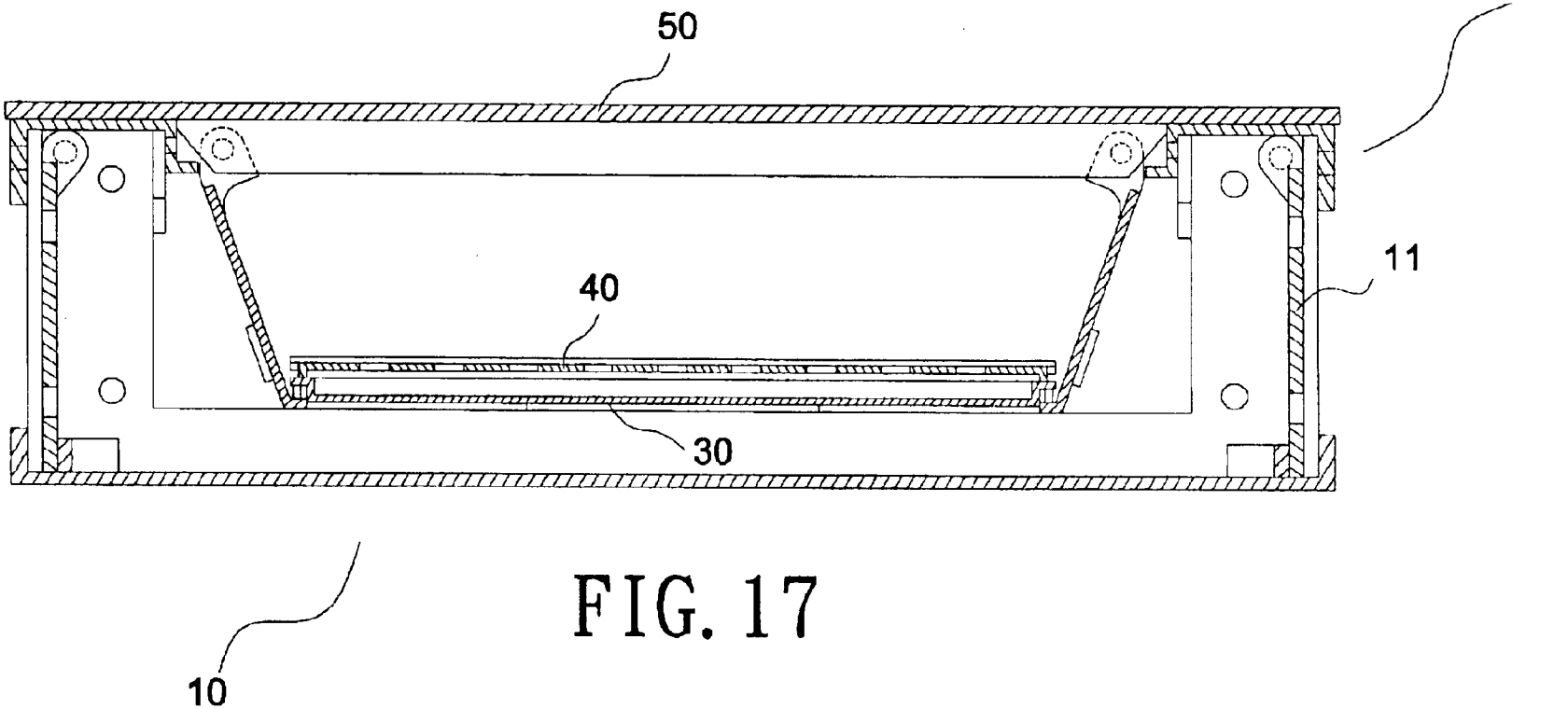
FIG. 17 is a fourth cutaway assembly view of a foldable conduction oven.

Referring to FIGS. 15 to 17, the fourth operate exemplary embodiment of the foldable conduction oven. The foldable conduction oven comprises 1 by a pedestal 10, a framework 20, an ash-collecting box 30, a grill 40 and a net 50.

The pedestal 10 is a square box and has four L-shaped prominences 13 in the inside.

The framework 20 comprises by two opposite outward plates 11, two opposite outward cover plates 21, two opposite inner cover plates 22, two opposite inner plates 23 and a frame 24.

The each outward plate 11 has two round prominent pellets.

The each inner cover plate 22 has two blockers 221 and a prominent piece 222 on the inner surface and two opposite lugs 223 on two ends, one round prominent pellet 224 on the one lug 223.

The each inner plate 23 has a prominent piece 231 and two opposite lugs 232 on two ends, one round prominent pellet 233 on the one lug 232.

The frame 24 has sixteen locational holes 241 to correspond the four round prominent pellets, which are on the two outward plates 11, the four round prominent pellets 213, which are on the four lugs 212 of the two outward cover plates 21, the four round prominent pellets 224, which are on the four lugs 223 of the two inner cover plates 22 and the four round prominent pellets 233, which are on the four lugs 232 of the two inner plates 23. The sixteen locational holes 241 are able to be wedged into the four round prominent pellets, which are on the two outward plates 11, the four round prominent pellets 213, which are on the two outward cover plates 21, the four round prominent pellets 224, which are on the two inner cover plates 22 and the four round prominent pellets 233, which are on the two inner plates 23. Then the two outward plates 11, the two outward cover plates 21, the two inner cover plates 22 and the two inner plates 23 are able to be folded on the frame 24.

In assembly, the framework 20 is put on the pedestal 10; the two outward plates 11 and the two outward cover plates 21 of the framework 20 are against the four L-shaped prominences 13 on the pedestal 10.

The ash-collecting box 30 is put on the two prominent pieces 222 of the two inner cover plates 22 and the two prominent pieces 231 of the two inner plates 23.

The grill 40 is put on the ash-collecting box 30.

The net 50 is put on the surface of the framework 20.

Figure 18:
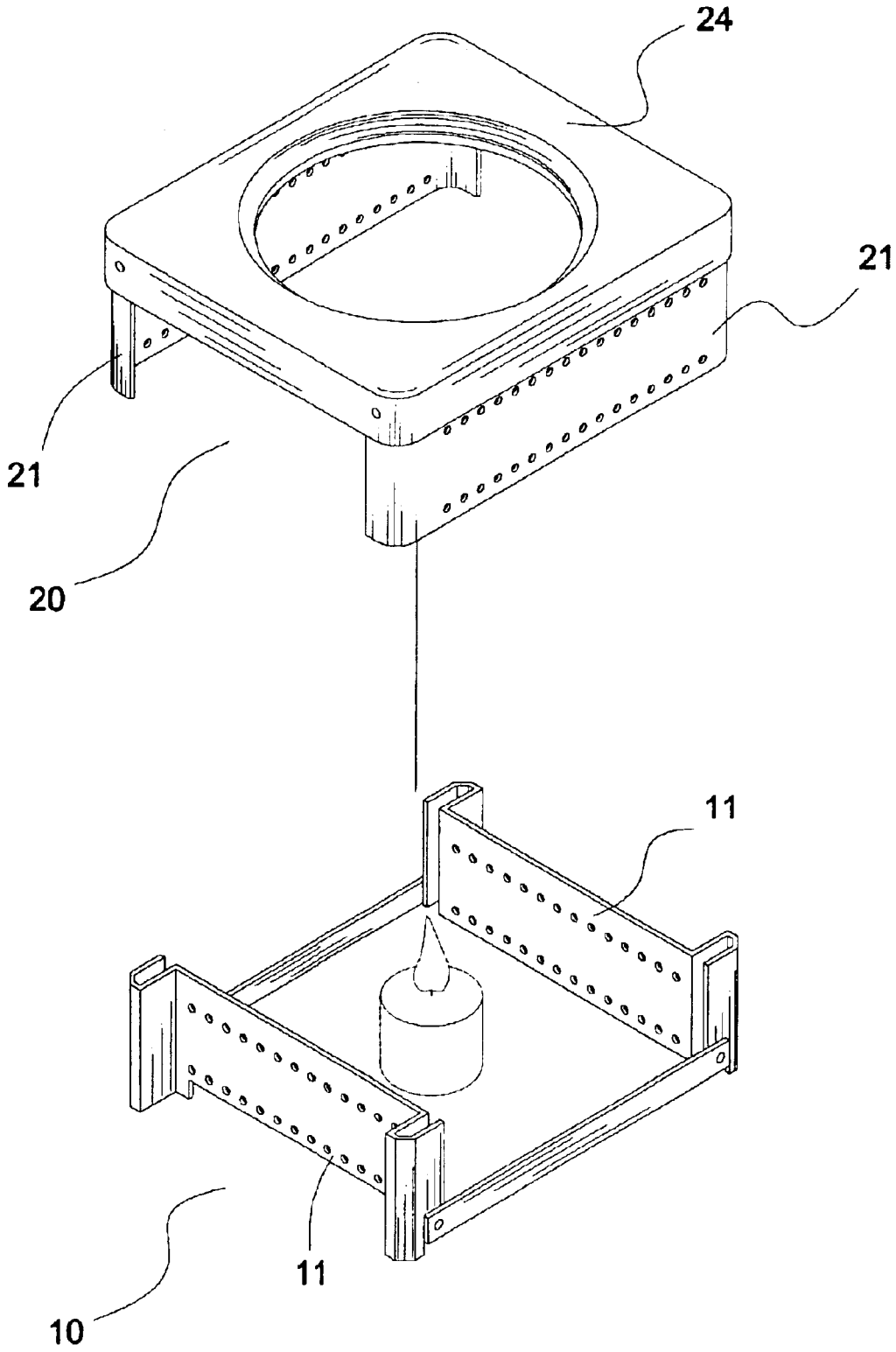
FIG. 18 is a fifth operate perspective exploded view of a foldable conduction oven.

Referring to FIG. 18, the fifth operate exemplary embodiment of the foldable conduction oven. The foldable conduction oven comprises by a pedestal 10 and a framework 20.

The pedestal 10 comprises by two opposite outward plates 11 and a chassis 12.

The framework 20 comprises by two opposite outward cover plates 21 and a frame 24. The frame has a big round hole in the central.

In assembly, put a candle or an alcohol burner on the central of the pedestal 10. The framework 20 is put on the pedestal 10.

I claim:

1. A foldable conduction oven comprising:

a. the pedestal comprises by two opposite outward plates and a chassis;

the each outward plates has many holes on the outside and two opposite side edges on two ends, one round prominent pellet on the one side edge, and the chassis has two long sides; the each long side has two locational holes on two sides; the four locational holes on the chassis correspond to the four round prominent pellets on the two side edges of the two outward plates, a framework comprises by two opposite outward cover plates, two opposite inner plates and a frame;

the each outward cover plate has many holes and two opposite lugs on two ends, one round prominent pellet on one two lug, the each inner cover plate has two blockers and a prominent piece on the inner surface and two opposite lugs on two ends, one round prominent pellet on each lug, the each inner plates has a prominent piece and two opposite lugs on two ends, one round prominent pellet on each lug, the frame has twelve locational holes to correspond the four round prominent pellets, which are on the two outward cover plates, the four round prominent pellets, which are on the two inner cover plates and the four round prominent pellets, which are on the two inner plates, an ash-collecting box;

a grill, and a net.

2. The foldable conduction oven of claim 1, wherein the said four locational holes on the said chassis are able to be wedged into the said round prominent pellets on the said two outward plates; then the said two outward plates are able to be foldable on the said chassis.

3. The foldable conduction oven of claim 1, wherein the said twelve locational holes on the said frame are able to be wedged into the said four round prominent pellets, which are on the said two outward cover plates, the said four round prominent pellets, which are on the said two inner cover plates and the said four round prominent pellets, which are on the said two inner plates; then the said outward cover plates,the said inner cover plates and the said inner plates are able to be folded on the said frame.

* * * * *